US012629604B1

(12) United States Patent
Cai

(10) Patent No.: US 12,629,604 B1
(45) Date of Patent: May 19, 2026

(54) TYPE OF SLIDE TOY

(71) Applicant: Yingxiao Cai, Shantou (CN)

(72) Inventor: Yingxiao Cai, Shantou (CN)

( * ) Notice: Subject to any disclaimer, the term of this patent is extended or adjusted under 35 U.S.C. 154(b) by 0 days.

(21) Appl. No.: 19/426,177

(22) Filed: Dec. 19, 2025

(51) Int. Cl.
*A63H 18/02* (2006.01)

(52) U.S. Cl.
CPC ..... *A63H 18/02* (2013.01)

(58) Field of Classification Search
CPC .... A63H 18/02; A63H 18/025; A63H 17/008; A63G 18/026; A63F 7/3622; A63F 7/28
See application file for complete search history.

(56) References Cited

U.S. PATENT DOCUMENTS 3,801,094 A * 4/1974 Treaster ..... A63F 7/3622 472/72
D983,888 S * 4/2023 Guo ..... D21/468
D1,082,950 S * 7/2025 Zhang ..... D21/475

OTHER PUBLICATIONS

"2 in 1 Pound Ball Toy & Car Ramp Race Track" YouTube video uploaded by ShopByKayy on Jul. 6, 2024 at https://www.youtube.com/watch?v=N4ce-A07zuQ (Year: 2024).*

* cited by examiner

*Primary Examiner* — Michael D Dennis
(74) *Attorney, Agent, or Firm* — JEEN IP LAW, LLC

(57) ABSTRACT

A new type of slide toy is provided, which includes a toy body; a track slide that is provided around the toy body; and a toy component that includes a toy platform, one or more toy balls, and one or more toy cars. The toy platform is provided on the toy body and provided with one or more rolling ball holes. The toy balls are configured to fall into the track slide through the rolling ball holes. The toy platform is provided with a starting slide rail, and the starting slide rail is connected to the track slide rail. The starting slide rail is provided with a starting slot configured to place the toy cars. When the toy cars are subjected to external force, the toy cars slide out from the starting slot. This application has the effect of improving the playability and fun of the slide toy.

10 Claims, 10 Drawing Sheets

TYPE OF SLIDE TOY

TECHNICAL FIELD

The present disclosure relates to the field of toys technologies, and in particular, to a new type of slide toy.

BACKGROUND

Toys are essential items to accompany children. With the increasing competition pressure in the toy market, the playability and fun of toys have become increasingly important in order to attract more users to purchase. Slide toys are a classic type of children's toy, mainly relying on track slides to guide sliding toys such as rolling balls to move along the track slide, thereby enhancing children's observation and attention.

The existing slide toys include a toy body and a track slide. The track slide is set around the toy body. When playing, a rolling ball is placed on the track slide, and then the rolling ball slides down the track slide, thereby completing the entire play process of the slide toy.

Regarding the relevant technologies mentioned above, the existing slide toys have relatively simple gameplay, only featuring the sliding process of rolling balls, which results in poor playability and fun. Children are easily bored while playing.

SUMMARY

In order to improve the playability and fun of slide toys, this application provides a new type of slide toy.

The new type of slide toy provided in this application adopts the following technical solution.

A new type of slide toy, including:

a toy body, a track slide that is provided around the toy body; and a toy component, and the toy component includes a toy platform, one or more toy balls, and one or more toy cars; where the toy platform is provided on the toy body, and the toy platform is provided with one or more rolling ball holes that are penetrated; the toy balls are configured to pass through the rolling ball holes and fall into the track slide; the toy platform is provided with a starting slide rail, and the starting slide rail is connected to the track slide; the starting slide rail is provided with a starting slot configured to place the toy cars; when the toy cars are subjected to external force, the toy cars are configured to slide out from the starting slot.

In some embodiments of the present disclosure, one end of the rolling ball holes is provided with a rolling ball ring, and the rolling ball ring is fixedly provided with one or more rolling ball protrusions having elasticity; when the toy balls enter the rolling ball holes, the toy balls contact and cooperate with the rolling ball protrusions, so that the toy balls cannot pass through the rolling ball holes; when the toy balls are subjected to external force, the toy balls pass through the rolling ball holes.

In some embodiments of the present disclosure, the toy component further includes a shooting hammer, and when the shooting hammer strikes the toy balls, the toy balls pass through the rolling ball holes.

In some embodiments of the present disclosure, the toy balls are provided with a light emitting module that is configured to emit light.

In some embodiments of the present disclosure, the track slide is provided with one or more slide exits.

In some embodiments of the present disclosure, when there are two slide exits, the track slides are rotatably connected to an adjustment lever, and when the adjustment lever is rotated, one slide exit is closed to allow the toy cars or toy balls to slide out from the other slide exit.

In some embodiments of the present disclosure, the toy component further includes a circular track, and the circular track is connected to the slide exit; the circular track is provided with a circular outlet, and the toy balls or toy cars are configured to slide out to the toy body through the circular outlet.

In some embodiments of the present disclosure, the toy component further includes an ejection component, and the ejection component includes an ejection rocker, an ejection button, and an ejection protrusion, where the ejection rocker is rotatably connected to the starting slide rail, the starting slide rail is provided with a button slot and an ejection slot, the ejection button is inserted and slid into the button slot, and the ejection button is in contact with one end of the ejection rocker, the ejection protrusion is inserted and slid into the ejection slot, and the ejection protrusion is in contact with the other end of the ejection rocker; when the toy cars are placed in the starting slot, the toy cars are in contact with the ejection protrusion.

In some embodiments of the present disclosure, the track slide includes a plurality of connection sections and a plurality of turning sections, and the connection sections and turning sections are alternately connected to form the track slide;

two ends of the connection sections are provided with connection slots, and slot bodies of the connection slots are provided with one or more connecting recesses; one or more connecting protrusions are fixedly provided at two ends of the turning sections; when the connection sections and the turning sections are connected, the turning sections are inserted into the connection slots and contact the slot bodies of the connection slots, and the connecting protrusions are inserted into the connecting recesses.

In some embodiments of the present disclosure, toy body includes a main body and a seat body, the main body is provided on the seat body, and the seat body is provided with a recycling chute configured to recycle the toy cars or toy balls that slide down from the track slide.

In summary, this application includes at least one beneficial technical effect as follows.

When children use slide toys for play, they can place toy balls or toy cars on the track slide, allowing the toy balls or toy cars to slide down from the track slide. They can also pass the toy balls through the rolling ball holes and fall onto the track slide, then slide down from the track slide. They can also place the toy cars in the starting slot, and then apply external force to push the toy cars out of the starting slot into the starting slide rail. The toy cars then slide out of the starting slide rail onto the track slide, and then slide down from the track slide, rendering the gameplay of the slide toys more diverse and rendering the playability and fun of the slide toy better. This improves the existing slide toy gameplay, which is relatively simple and only has the sliding process of the rolling ball, with poor playability and fun. Which may cause a problem of children easily feeling bored while playing.

Numeral reference: 1—toy body; 11—main body; 111—installation protrusion; 112—image slot; 113—track recess; 12—seat body; 121—installation recess; 122—recycling chute; 123—shooting hole; 2—track slide; 21—connection section; 211—connection slot; 2111—connecting recess; 212—track protrusion; 22—turning section; 221—connecting protrusion; **2*a*—slide exit; 2*a*1—bottom exit; 2*a*2—central exit; 2*b*—adjustment lever; 3—toy component; 31—toy platform; 311—rolling ball hole; 3111—rolling ball ring; 31111—rolling ball protrusion; 312—starting slide rail; 3121—starting slot; 3122—button slot; 3123—ejection slot; 313—image; 314—parking slot; 320—toy ball; 321—light emitting module; 322—light emitting slot; 33—toy car; 34—circular track; 341—circular outlet; 35—shooting hammer; 36—ejection component; 361—ejection rocker; 362—ejection button; 363**—ejection protrusion.

DESCRIPTION OF EMBODIMENTS

Further detailed explanations of the present application will be provided in combination with FIGS. 1 to 10.

Figure 1:
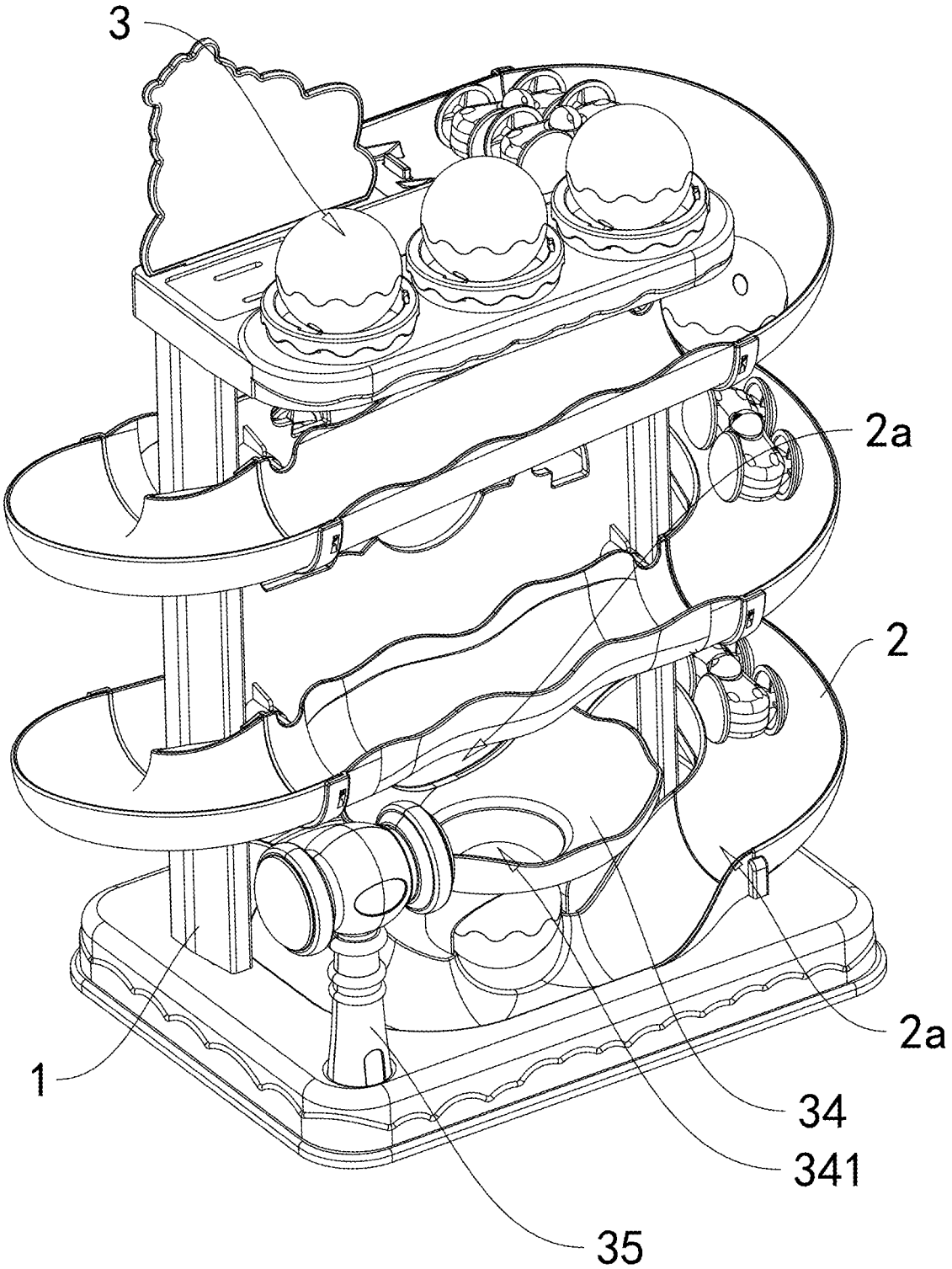
FIG. 1 is a first schematic diagram of an overall structure of an embodiment of the present application.
Figure 2:
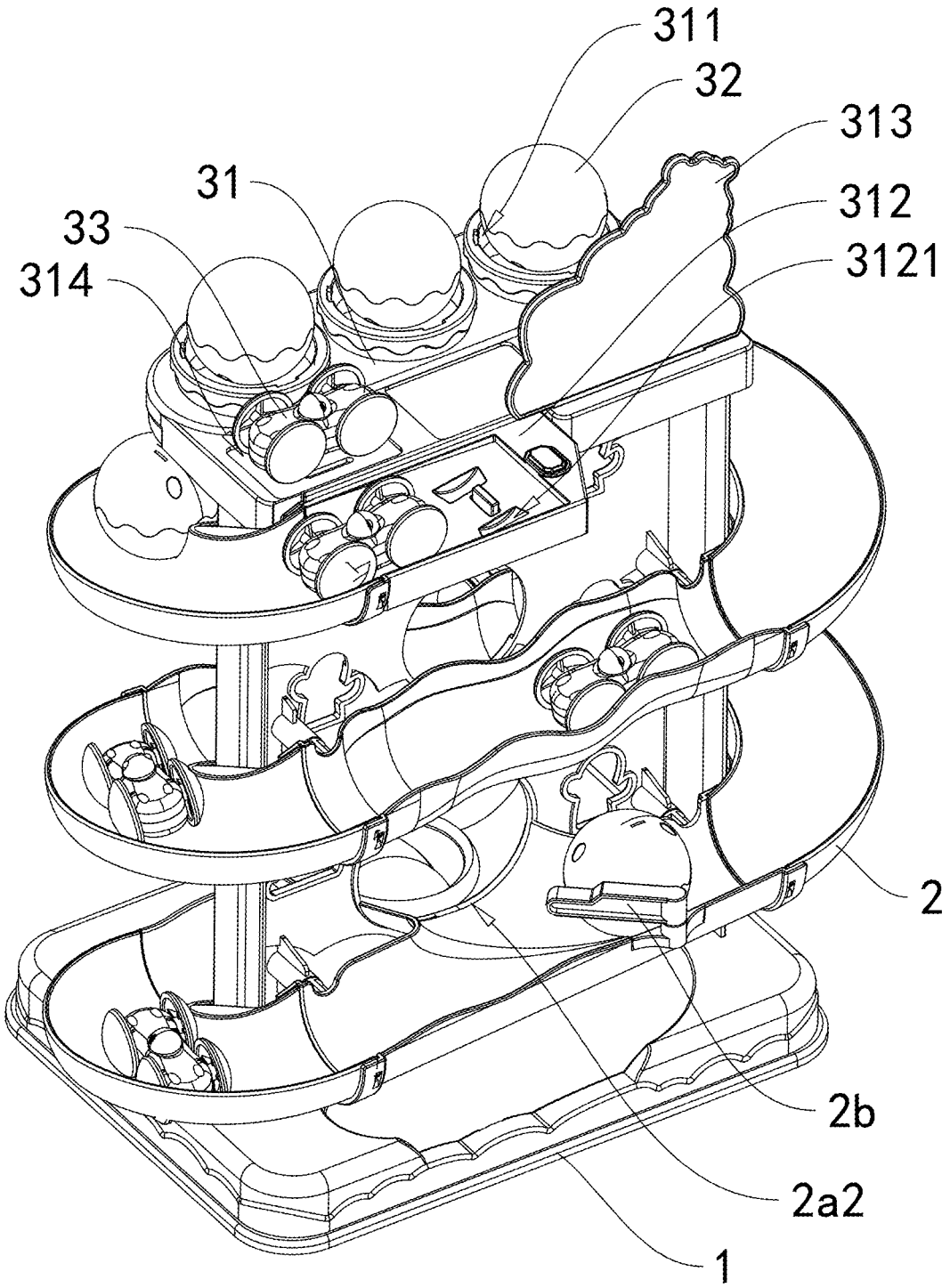
FIG. 2 is a second schematic diagram of the overall structure of the embodiment of the present application.

This application discloses a new type of slide toy. Referring to FIGS. 1 and 2, the new type of slide toy includes a toy body 1, a track slide 2, and a toy component 3. The track slide 2 is surrounded by the toy body 1, and the toy component 3 includes a toy platform 31, a plurality of toy balls 32, and a plurality of toy cars 33. The toy platform 31 is provided on the toy body 1, and is provided with a plurality of rolling ball holes 311 that are penetrated through. The toy balls 32 can fall into the track slide 2 through the rolling ball holes 311. The toy platform 31 is provided with a starting slide rail 312, and the starting slide rail 312 is connected to the track slide 2. The starting slide rail 312 is provided with a starting slot 3121 configured to place the toy cars 33. When the toy cars 33 are subjected to external force, the toy cars 33 slide out of the starting slot 3121 and pass through the starting slide rail 312 to slide onto the track slide 2, which can be understood as matching the size of the toy cars 33 provided with the slide toy itself. The toy cars 33 can be completely placed inside the track slide 2, so that the toy cars 33 can slide down along the track slide 2.

Figure 3:
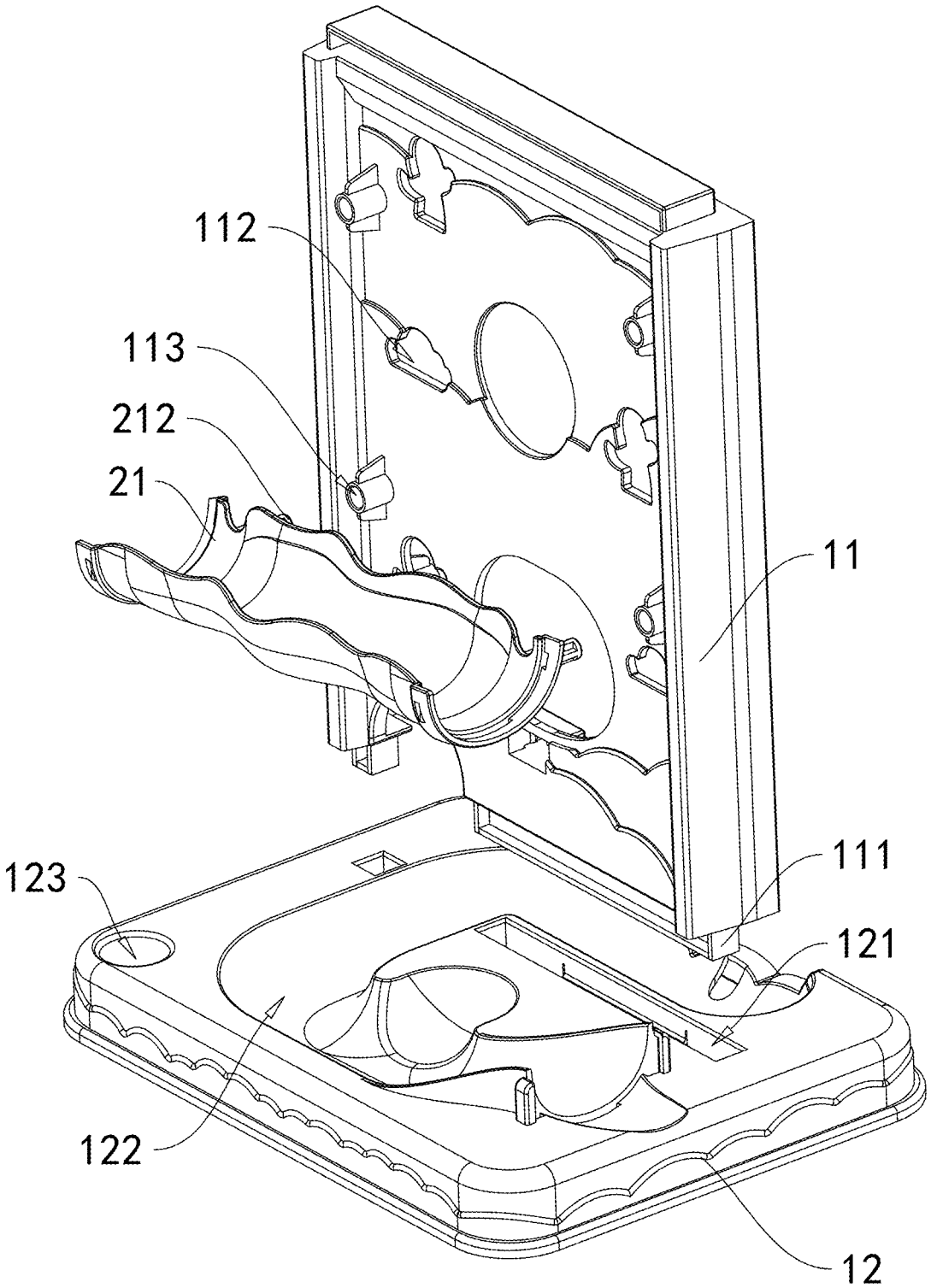
FIG. 3 is an exploded structural view of a toy boy in an embodiment of the present application.

Referring to FIG. 3, in an embodiment of the present application, the toy body 1 includes a main body 11 and a seat body 12. The main body 11 is provided on the seat body 12. It can be understood that one installation method for the main body 11 to be provided on the seat body 12 is that a bottom of the main body 11 is fixedly provided with an installation protrusion 111, and the seat body 12 is provided with an installation recess 121. When the installation protrusion 111 passes through the installation recess 121, the main body 11 is provided on the seat body 12, and the main body 11 is provided with a plurality of image slots 112 for increasing the fun of the slide toy. The seat body 12 is provided with a recycling chute 122, and the recycling chute 122 is configured to recycle the toy cars 33 or toy balls 32 that slide off the track slide 2.

Figure 4:
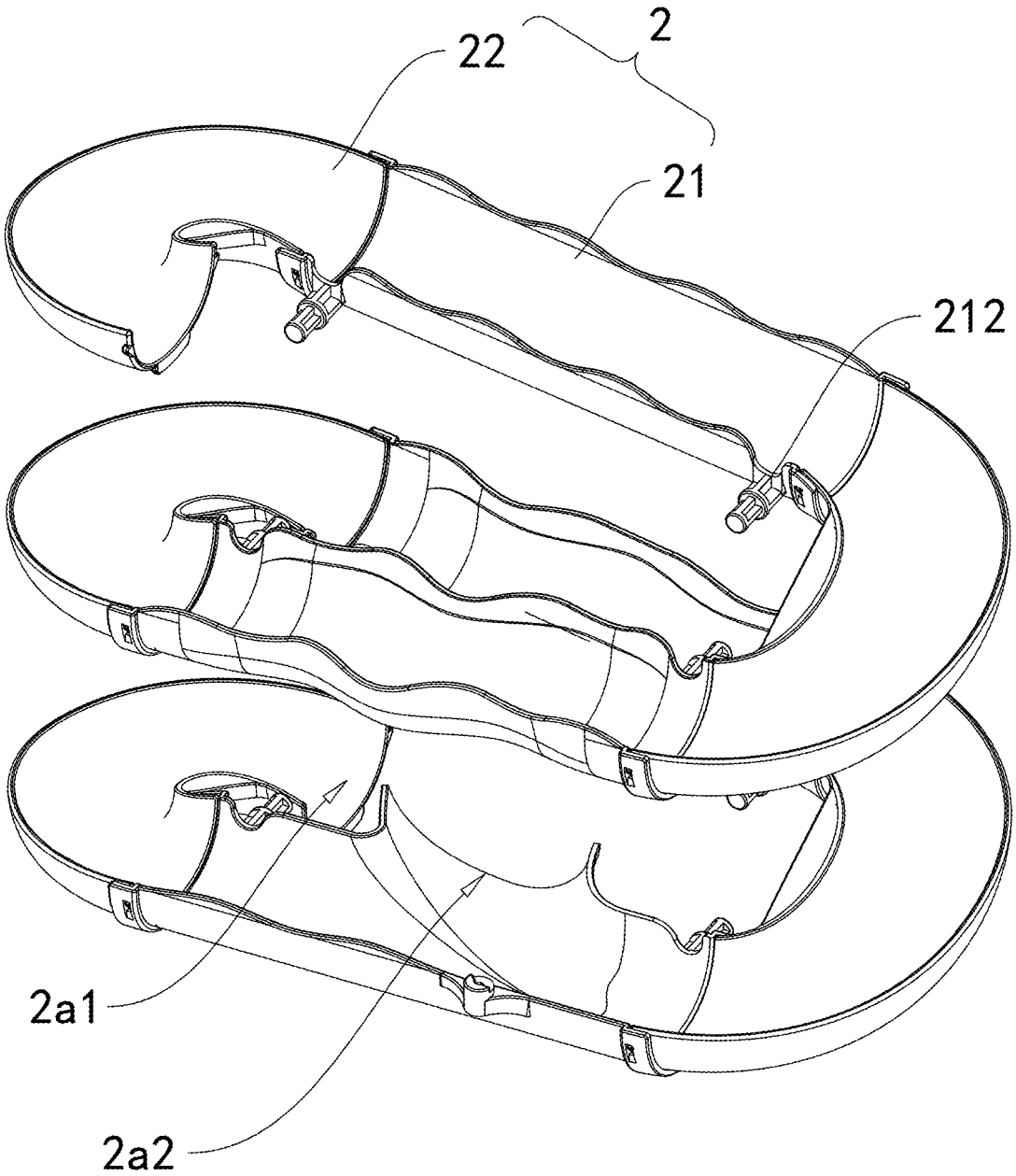
FIG. 4 is a schematic structural diagram of a track slide in an embodiment of the present application.
Figure 5:
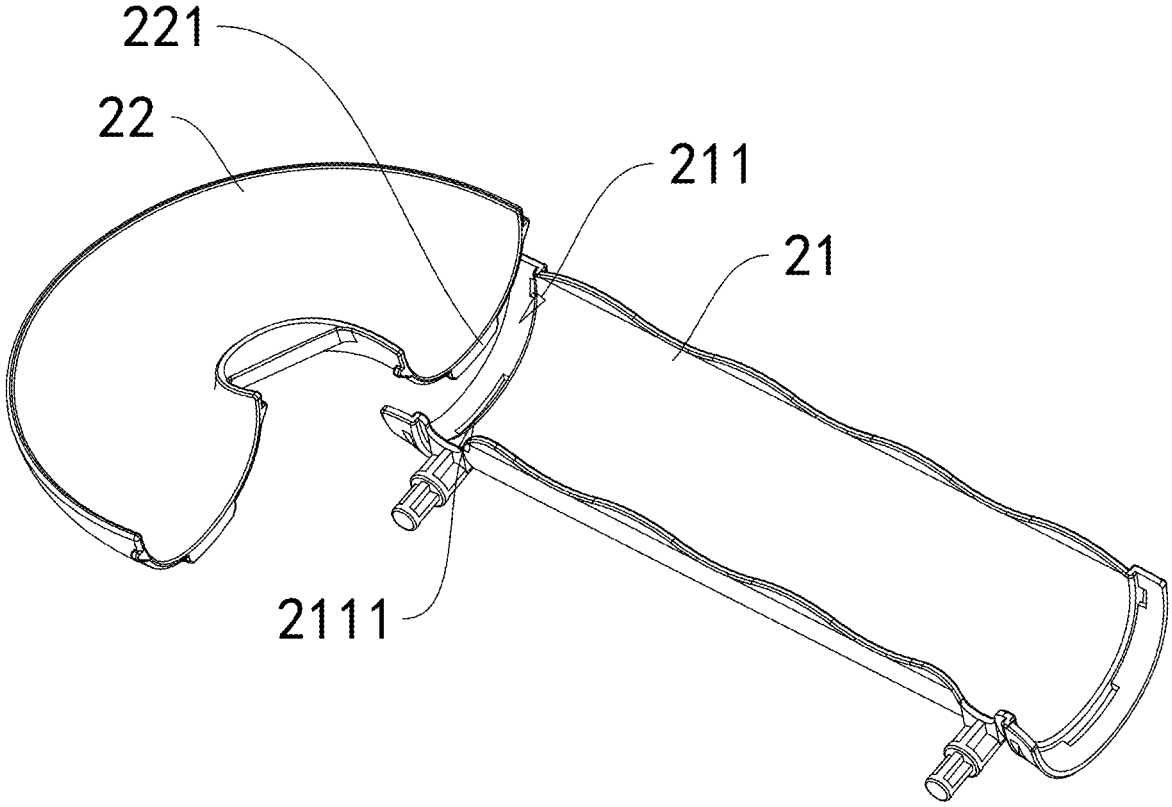
FIG. 5 is a schematic diagram of a connection between a connection section and a turning section in an embodiment of the present application.

Referring to FIGS. 4 and 5, the track slide 2 includes a plurality of connection sections 21 and a plurality of turning sections 22. The connection sections 21 and turning sections 22 are connected in a staggered manner to form the track slide 2. Two ends of the connection sections 21 are provided with connection slots 211, and slot bodies of the connection slots 211 are provided with a plurality of connecting recesses 2111. A plurality of connecting protrusions 221 are fixedly provided at two ends of the turning sections 22. When the connection sections 21 and the turning sections 22 are connected, the turning sections 22 pass through the connection slots 211 and are in contact with the slot bodies of the connection slots 211, and the connecting protrusions 221 pass through the connecting recesses 2111, so that each of the connection sections 21 and each of the turning sections 22 are connected in a staggered manner to form the track slide 2. It can be understood that each of the connection sections 21 is fixedly provided with track protrusions 212, and the main body 11 is provided with a plurality of track recesses 113. When the track slide 2 is provided on the toy body 1, each of the track protrusions 212 is respectively inserted into each of the track recesses 113, so that each of the connection sections 21 is provided on the toy body 1, and each of the turning sections 22 is connected to each of the connection sections 21, and one end of the turning sections 22 near the seat body 12 is connected to the seat body 12, thereby ensuring that each of the turning sections 22 is stably provided on the toy body 1.

Figure 6:
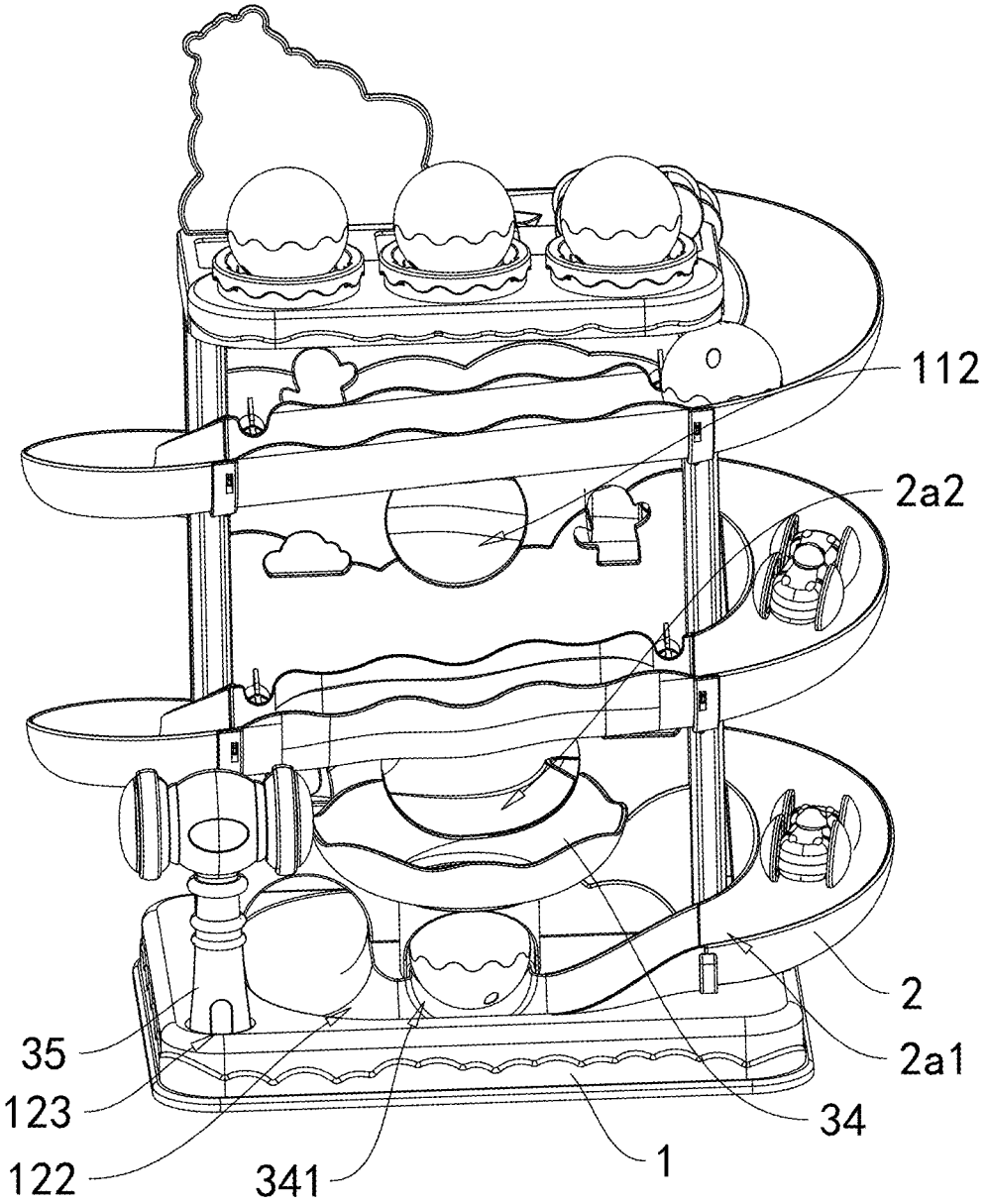
FIG. 6 is a third schematic diagram of the overall structure of the embodiment of the present application.

Referring to FIGS. 2, 4, and 6, in an embodiment of the present application, the track slide 2 is provided with two slide exits **2*a*, one of which is a bottom exit 2*al* and the other is a middle exit 2*a*2. The bottom exit 2*al* is connected to the recycling chute 122. It can be understood that when the toy balls 32 or toy cars 33 slide out of the track slide 2 from the bottom exit 2*a*1, the toy balls 32 or toy cars 33 can enter the recycling chute 122 and be subsequently recycled by the recycling chute 122, rendering it convenient for children to slide the toy balls 32 or toy cars 33 off the track slide 2 again. In an implementation mode, the toy component 3 further includes a circular track 34, and the circular track 34 is connected to the middle exit 2*a*2. The circular track 34 is provided with a circular outlet 341, and the circular outlet 341 is communicated to the recycling chute 122. It can be understood that toy balls 32 or toy cars 33 can pass through the central exit 2*a*2 enter the circular track 34 and then slide out from the circular outlet 341 of the circular track 34 into the recycling chute 122, allowing the toy balls 32 or toy cars 33 to be recycled by the recycling chute 122**.

Referring to FIG. 2, in an implementation mode, the track slide 2 is rotatably connected to an adjustment lever **2*b*. It can be understood that when the adjustment lever 2*b* is rotated to block the track slide 2 inside the track slide 2, the adjustment lever 2*b* closes the track slide 2 that is sliding towards the bottom exit 2*al*, so that the toy balls 32 or toy cars 33 slide out of the track slide 2 from the middle exit 2*a*2. When the adjustment lever 2*b* rotates to an outside of the track slide 2 and cannot block the track slide 2, the track slide 2 that is sliding towards the bottom exit 2*al*** is opened.

At this time, the toy balls 32 or toy cars 33 will slide out along the track slide 2 from the bottom exit 2*al*.

Figure 7:
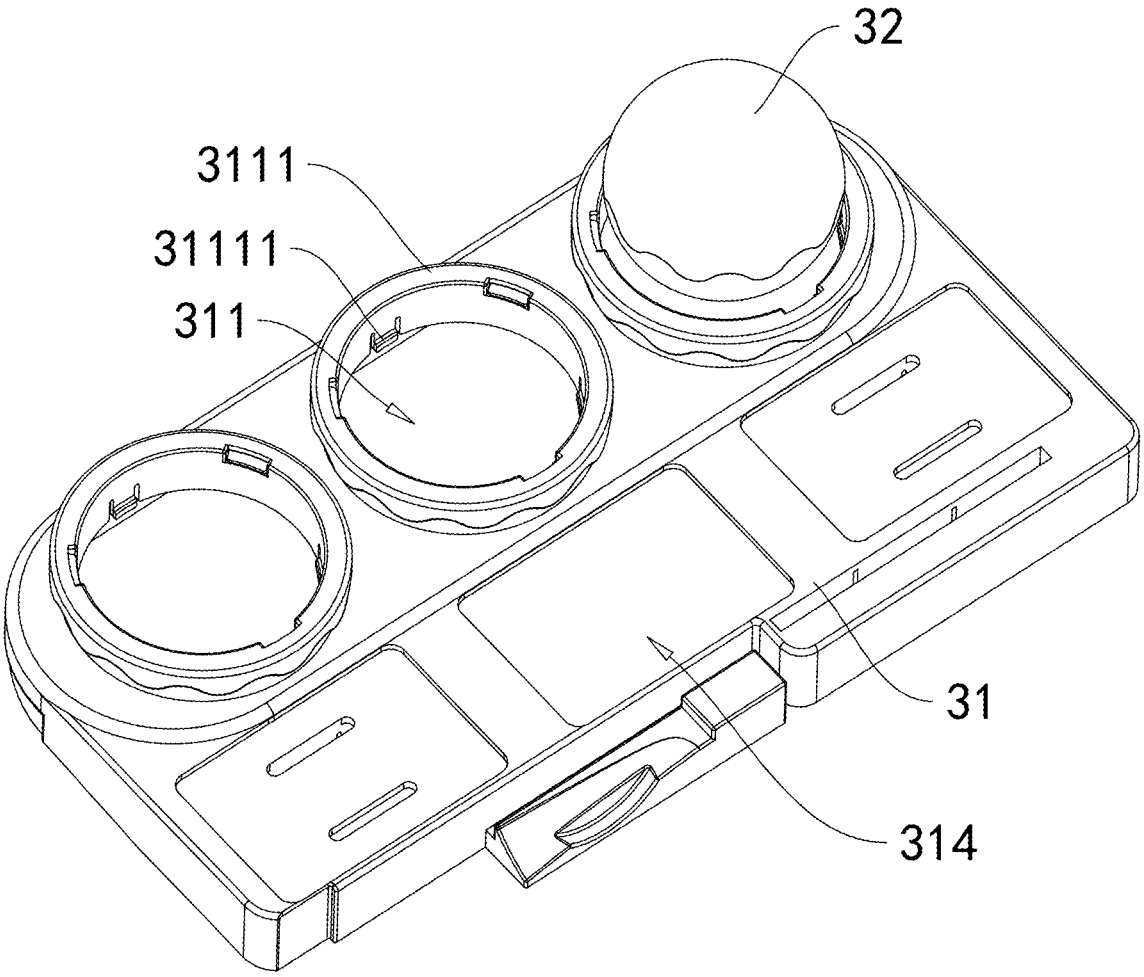
FIG. 7 is a schematic structural diagram of a toy platform according to an embodiment of the present application.

Referring to FIG. 7, in an embodiment of the present application, each of the rolling ball holes 311 is provided with a rolling ball ring 3111 at one end. The rolling ball ring 3111 can be fixedly provided at one end of the rolling ball holes by clamping and cooperating with one end of the rolling ball holes 311. The rolling ball ring 3111 is fixedly provided with a plurality of rolling ball protrusions 31111, which are evenly distributed around an axis of the rolling ball ring 3111. Each of the rolling ball protrusions 31111 has elasticity. It can be understood that when the toy balls 32 enter the rolling ball holes 311, the toy balls 32 and each of the rolling ball protrusions 31111 are in contact and cooperate, so that the toy balls 32 cannot pass through the rolling ball holes 311. When the toy balls 32 are subjected to external force, the toy balls 32 push each rolling ball. The rolling ball protrusions 31111 are offset towards a direction close to the rolling ball ring 3111, allowing the toy balls 32 to smoothly disengage from a contact fit with each of the rolling ball protrusions 31111, so that the toy balls 32 can pass through the rolling ball holes 311 and fall into the track slide 2, and then slide out of the track slide 2.

Referring to FIG. 6, in an implementation mode, the toy component 3 further includes a shooting hammer 35. It can be understood that when children use the slide toy for play, they can swing the shooting hammer 35 to strike the toy balls 32 placed in the rolling ball holes 311, so that the toy balls 32 struck by the shooting hammer 35 can pass through the rolling ball holes 311 and fall into the track slide 2, thereby further increasing the playability and fun of the slide toy. Besides that, the seat body 12 is provided with a shooting hole 123 for placing the shooting hammer 35. It can be understood that when children do not need to use the shooting hammer 35, a handle of the shooting hammer 35 can be inserted into the shooting hole 123, so that the shooting hammer 35 can be provided on the seat body 12, This enables the placement of the shooting hammer 35, rendering it easier for children to quickly retrieve it a next time they need to use it.

Referring to FIGS. 1 and 2, in an implementation mode, the toy platform 31 is provided with an image 313 to increase the visual fun of the slide toys. The toy platform 31 also has a plurality of parking slots 314 configured to place the toy cars 33, so that when the toy cars 33 are not used for play, they can be placed in the parking slots 314 for parking.

Figure 8:
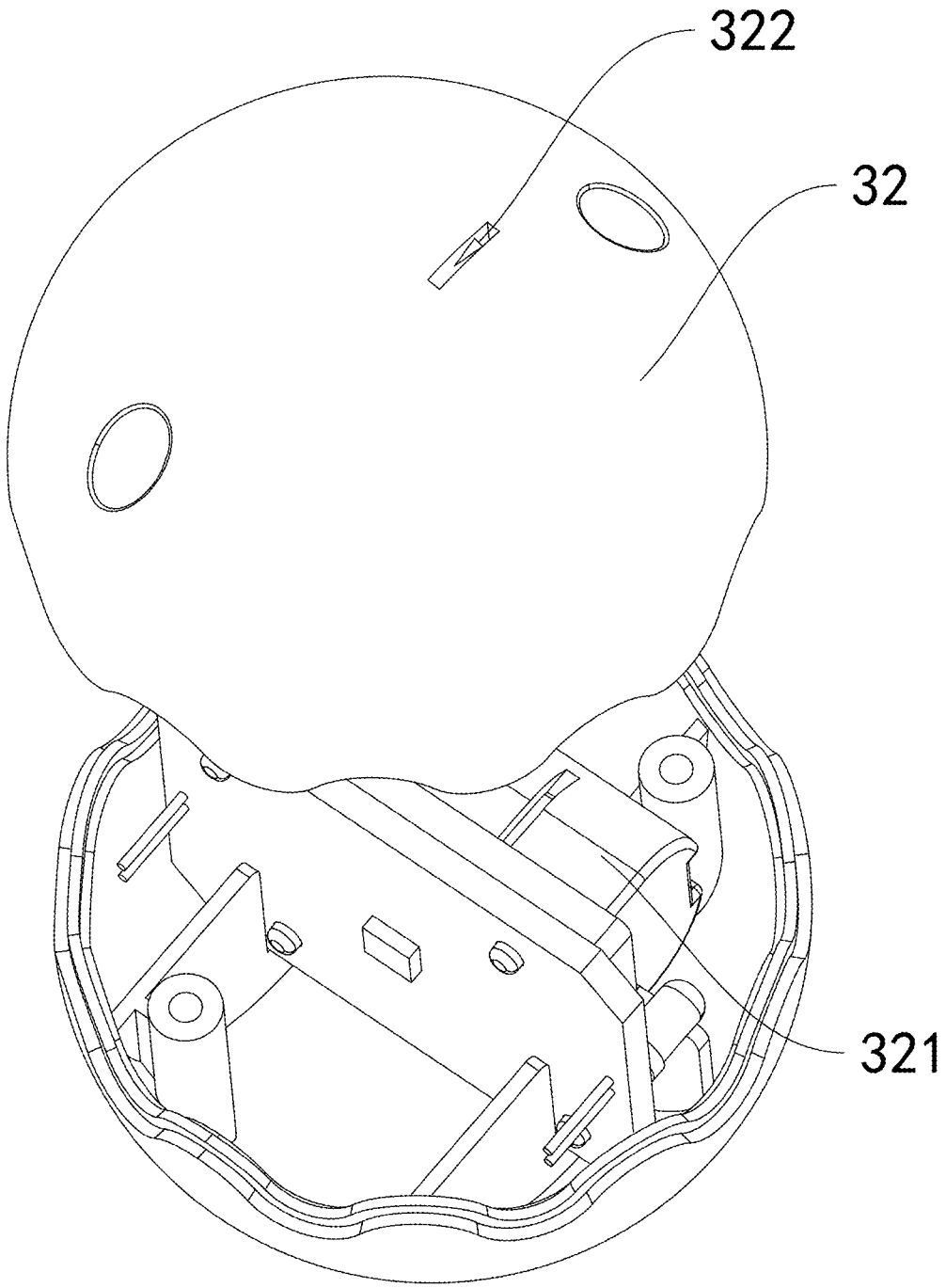
FIG. 8 is an exploded structural view of toy balls according to an embodiment of the present application.

Referring to FIG. 8, in this embodiment, each of the toy balls 32 is provided with a light emitting module 321 that can emit light, so that each of the toy balls 32 can emit various colors of light, thereby providing children with a better visual experience of the toy balls 32 and increasing the playability and fun of the slide toy. Each of the toy balls 32 is provided with a light emitting slot 322 configured to insert an obstacle, which can be a card structure. This is not limited in this embodiment. It can be understood that the light emitting module 321 of each of the toy balls 32 is powered by button batteries. Therefore, when the light emitting module 321 does not need to emit light, the obstacle can be inserted from the light emitting slot 322 into the light emitting module 321, thereby cutting off power supply of the button battery to the light emitting module 321, stopping the light emitting module 321 from emitting light. When the light emitting module 321 needs to emit light, the obstruction is removed from the light emitting slot 322, so that the button battery can supply power to the light emitting module 321, and the light emitting module 321 is caused to emit light.

Figure 9:
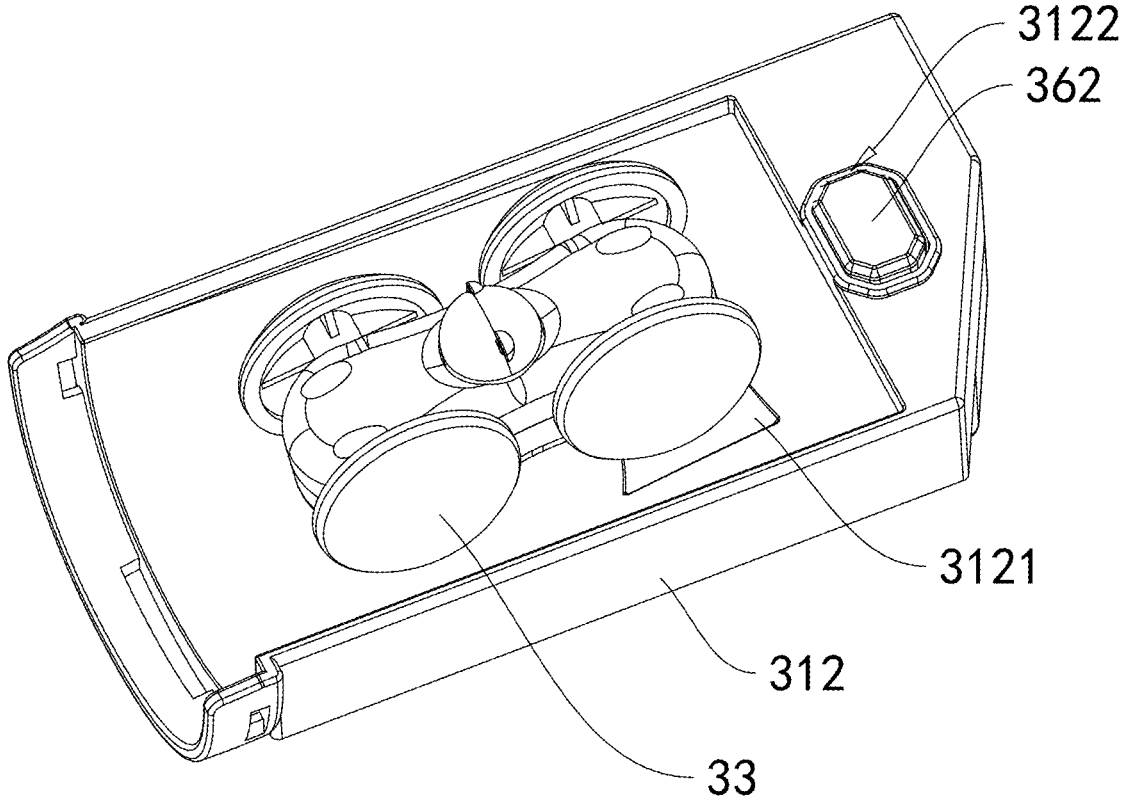
FIG. 9 is a schematic structural diagram of a starting slide rail in an embodiment of the present application.
Figure 10:
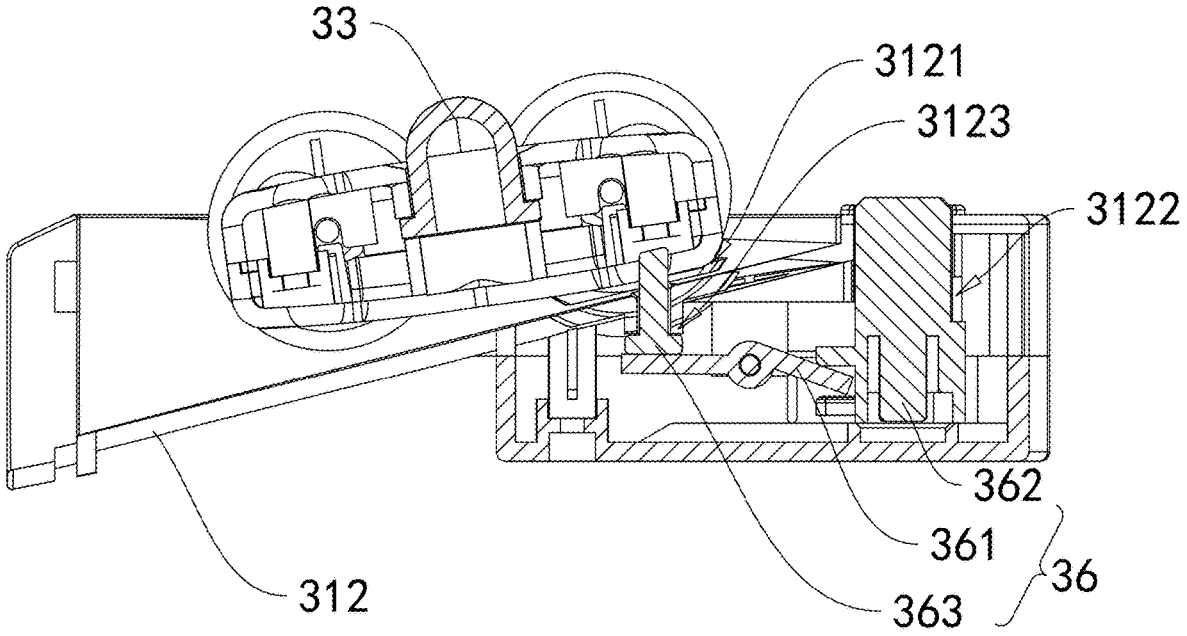
FIG. 10 is a sectional structural view of the starting slide rail of an embodiment of the present application.

Referring to FIGS. 9 and 10, in an embodiment of the present application, the toy component 3 further includes an ejection component 36, and the ejection component 36 includes an ejection rocker 361, an ejection button 362, and an ejection protrusion 363. The ejection rocker 361 is rotatably connected to an interior of the starting slide rail 312, and the starting slide rail 312 is provided with a button slot 3122 and an ejection slot 3123. The ejection button 362 is inserted and slid into the button slot 3122, and is in contact with one end of the ejection rocker 361. One end of the ejection protrusion 363 is inserted and slid into the ejection slot 3123, so that when the toy cars 33 are placed in the starting slot 3121, the toy cars 33 are in contact with the ejection protrusion 363, and the other end of the ejection protrusion 363 is in contact with the other end of the ejection rocker 361. In an implementation mode, there are two starting slots 3121. The ejection protrusion 363 is provided between the two starting slots 3121. Of course, the starting slot 3121 can also be one, without limitation. It can be understood that when the toy cars 33 are placed in the starting slot 3121 and are in contact with the ejection protrusion 363, the ejection protrusion 363 pushes the ejection rocker 361 under the weight of the toy cars 33 itself, the ejection rocker 361 is caused to rotate and push the ejection button 362 to slide away from the starting slide rail 312, thereby exposing the ejection button 362 on a surface of the starting slide rail 312 and being in a pushing state. When the toy cars 33 need to slide out of the starting slot 3121, the user can directly manually push the toy cars 33 to apply external force, the toy cars 33 are caused to slide out of the starting slot 3121. The ejection button 362 can also be pressed, the ejection button 362 is caused to push the ejection rocker 361 to rotate and push the ejection protrusion 363 to slide away from the starting slide rail 312, the ejection protrusion 363 is caused to push the toy cars 33 out of the starting slot 3121, this further increases the playability and fun of the slide toys.

The implementation principle of the new type of slide toy in this application is as follows: when children play with the slide toy, they can place the toy balls 32 or toy cars 33 on the track slide 2, let the toy balls 32 or toy cars 33 slide down from the track slide 2, or pass the toy balls 32 through the rolling ball holes 311 and fall into the track slide 2, and then slide down from the track slide 2. The toy cars 33 can also be placed in the starting slot 3121, and then pushed out of the starting slot 3121 into the starting slide rail 312 by applying the external force to the toy cars 33, and then the toy cars 33 slide out of the starting slide rail 312 to the track slide 2, and then slide down from the track slide 2, rendering the gameplay of the slide toy more diversified, thereby making the play of the slide toy more diverse. The playability and fun of slide toys are better, which improves the existing single gameplay of slide toys, only having the sliding process of rolling balls, with poor playability and fun, makes it easy for children to feel bored while playing.

The above are the preferred embodiments of the present application and do not limit the protection scope of the present application. Therefore, any equivalent changes made according to the structure, shape, and principle of the present application should be included in the protection scope of the present application.

What is claimed is:

1. A new type of slide toy, comprising:

a toy body, a track slide that is provided around the toy body; and a toy component, and the toy component comprises a toy platform, one or more toy balls, and one or more toy cars;

wherein the toy platform is provided on the toy body, and the toy platform is provided with one or more rolling ball holes that are penetrated; the one or more toy balls are configured to pass through the one or more rolling ball holes and fall into the track slide; the toy platform is provided with a starting slide rail, and the starting slide rail is connected to the track slide;

the starting slide rail is provided with a starting slot configured to place the one or more toy cars;

when the one or more toy cars are subjected to external force, the one or more toy cars are configured to slide out from the starting slot.

2. The new type of slide toy according to claim 1, wherein one end of the one or more rolling ball holes is provided with a rolling ball ring, and the rolling ball ring is fixedly provided with one or more rolling ball protrusions having elasticity;

when the one or more toy balls enter the one or more rolling ball holes, the one or more toy balls contact and cooperate with the one or more rolling ball protrusions, so that the one or more toy balls cannot pass through the one or more rolling ball holes;

when the one or more toy balls are subjected to external force, the one or more toy balls pass through the one or more rolling ball holes.

3. The new type of slide toy according to claim 2, wherein the toy component further comprises a shooting hammer, and when the shooting hammer strikes the one or more toy balls, the one or more toy balls pass through the one or more rolling ball holes.

4. The new type of slide toy according to claim 1, wherein the one or more toy balls are provided with a light emitting module that is configured to emit light.

5. The new type of slide toy according to claim 1, wherein the track slide is provided with one or more slide exits.

6. The new type of slide toy according to claim 5, wherein when there are two slide exits, the track slide is rotatably connected to an adjustment lever, and when the adjustment lever is rotated, one slide exit is closed to allow the one or more toy cars or the one or more toy balls to slide out from the other slide exit.

7. The new type of slide toy according to claim 5, wherein the toy component further comprises a circular track, and the circular track is connected to the one or more slide exits;

the circular track is provided with a circular outlet, and the one or more toy balls or one or more toy cars are configured to slide out to the toy body through the circular outlet.

8. The new type of slide toy according to claim 1, wherein the toy component further comprises an ejection component, and the ejection component comprises an ejection rocker, an ejection button, and an ejection protrusion, wherein the ejection rocker is rotatably connected to the starting slide rail, the starting slide rail is provided with a button slot and an ejection slot, the ejection button is inserted and slid into the button slot, and the ejection button is in contact with one end of the ejection rocker, the ejection protrusion is inserted and slid into the ejection slot, and the ejection protrusion is in contact with the other end of the ejection rocker;

when the one or more toy cars are placed in the starting slot, the one or more toy cars are in contact with the ejection protrusion.

9. The new type of slide toy according to claim 1, wherein the track slide comprises a plurality of connection sections and a plurality of turning sections, and the plurality of connection sections and plurality of turning sections are alternately connected to form the track slide;

two ends of the plurality of connection sections are provided with connection slots, and slot bodies of the connection slots are provided with one or more connecting recesses;

one or more connecting protrusions are fixedly provided at two ends of the plurality of turning sections;

when the plurality of connection sections and the plurality of turning sections are connected, the plurality of turning sections are inserted into the connection slots and contact the slot bodies of the connection slots, and the one or more connecting protrusions are inserted into the one or more connecting recesses.

10. The new type of slide toy according to claim 1, wherein the toy body comprises a main body and a seat body, the main body is provided on the seat body, and the seat body is provided with a recycling chute configured to recycle the one or more toy cars or the one or more toy balls that slide down from the track slide.

* * * * *